US006313718B1

(12) United States Patent
Horie

(10) Patent No.: US 6,313,718 B1
(45) Date of Patent: Nov. 6, 2001

(54) HIGH FREQUENCY DIELECTRIC DEVICE

(75) Inventor: Kenichi Horie, Machida (JP)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 09/439,196

(22) Filed: Nov. 12, 1999

(30) Foreign Application Priority Data

Nov. 19, 1998 (JP) ..... 10-329421

(51) Int. Cl.[7] ..... H01P 1/203

(52) U.S. Cl. ..... 333/204; 333/203; 333/202; 333/206

(58) Field of Search ..... 257/607, 608, 257/609; 333/204, 203, 202, 206, 219, 222, 246, 236, 238, 243, 244, 116, 128

(56) References Cited

U.S. PATENT DOCUMENTS

| | | | | |
|---|---|---|---|---|
| 4,506,241 | * | 3/1985 | Makimoto et al. | 333/222 |
| 4,785,271 | * | 11/1988 | Higgins, Jr. | 333/204 |
| 5,012,319 | | 4/1991 | Dykaar et al. | 357/55 |
| 5,072,201 | | 12/1991 | Devaux et al. | 333/128 |
| 5,124,676 | * | 6/1992 | Ueno | 333/206 |
| 5,160,905 | * | 11/1992 | Hoang | 333/204 |
| 5,349,314 | * | 9/1994 | Shimizu et al. | 333/204 |
| 5,391,543 | | 2/1995 | Higaki et al. | 505/210 |
| 5,404,120 | * | 4/1995 | Ahahi-Kesheh | 333/206 |
| 5,410,285 | * | 4/1995 | Konishi | 333/206 |
| 5,426,399 | | 6/1995 | Matsubayashi et al. | 333/1 |
| 5,489,882 | * | 2/1996 | Ueno | 333/206 |
| 5,894,252 | * | 4/1999 | Oida | 333/202 |

FOREIGN PATENT DOCUMENTS

| | | | |
|---|---|---|---|
| WO9626555 | 8/1996 | (WO) | H01P/3/08 |

OTHER PUBLICATIONS

"Electrical Lengths of Stripline Bends", Electronics Letters, vol. 6., No. 16, Aug. 6, 1970, pp. 494–496, XP002126627, IEE Stevenage., GB ISSN: 0013–5194, p. 495, Right Hand col., Line 4–Line 9; Figure 3.

* cited by examiner

*Primary Examiner*—Charles Bowers
*Assistant Examiner*—Laura M Schillinger
(74) *Attorney, Agent, or Firm*—Norman N. Spain

(57) ABSTRACT

A dielectric device for high frequency application with a reduced loss of a high frequency component has at least a first dielectric on which a conductor is disposed and a second dielectric laminated on this dielectric and an additional dielectric with a dielectric constant lower than those of the first and second disposed in the vicinity of the side edge of the conductor.

4 Claims, 2 Drawing Sheets

HIGH FREQUENCY DIELECTRIC DEVICE

The present invention relates to a dielectric device and, more particularly, to a dielectric device for high frequency application such as a filter. The invention also relates to a method of manufacturing such a dielectric device.

BACKGROUND OF THE INVENTION

A dielectric device for high frequency application such as a filter has been conventionally formed as described below.

First, there is prepared a green sheet made of a dielectric material, e.g., a ceramic material. Electrode paste including mainly silver and an organic binder in an appropriate quantity is applied to a desired position on the sheet by, e.g., silk printing, followed by drying, thereby obtaining an inner electrode. A detailed description will be given below. As schematically shown in FIG. 3, a screen stencil mask 3 with an opening having a desired shape, i.e., a screen mesh 2 in this example formed thereon is registered at a desired position on a ceramic green sheet 1. Next, electrode paste 4 is applied onto the mask 3 and spread in a direction, e.g., indicated by an arrow in FIG. 3 by the use of a rubber squeezer 5. As a result, the electrode paste 3 is applied onto the green sheet 1 through the screen mesh 2, followed by drying, thus forming an inner electrode.

Subsequently, as schematically shown in FIG. 4, another ceramic green sheet 7 is laminated on the green sheet 1 having the inner electrode 6 printed at the upper surface thereof, followed by pressing so as to bring both the sheets into close contact with each other. Thereafter, a sintering treatment is performed by heating. The green sheet 7 may be provided with an electrode at the upper surface thereof in a manner similar to the sheet 1, or may be a dummy green sheet having no electrode thereon. A multi-layer dielectric device is obtained by combining the desired number of pairs of a green sheet having an electrode formed at the upper surface thereof and a dummy green sheet having no electrode thereon. Finally, a given outer electrode is disposed at a predetermined side surface, thus forming a dielectric device.

FIG. 5 is a schematic cross-sectional view showing the conventional high frequency dielectric device formed as described above, partly cut away in a thickness direction. As is obvious from FIG. 5, in the conventional high frequency dielectric device, the inner electrode 6 is flat, and side edges 8 of the electrode 6 are sharply tapered. This is because the inner electrode 6 is pressed in the thickness direction of the dielectric device by pressing, in particular, before sintering the device.

As is well known, in the case where a current flows in a conductor, the current inside the conductor becomes smaller due to a skin effect while the current tends to be concentrated at the surface of the conductor. Particularly, this tendency becomes more prominent at higher frequency. That is, in the case where a high frequency current flows in a conductor, the current is concentrated on the surface of the conductor due to the skin effect so as to reduce an effective cross-sectional area of the conductor, resulting in an apparent increase in electric resistance. This induces an ohmic loss of a current component.

Here, if a high frequency current flows in the high frequency dielectric device shown in FIG. 5, the current is concentrated on the surface of the inner electrode 6 due to the skin effect. Particularly, since in the conventional high frequency dielectric device shown in FIG. 5, the inner electrode 6 is flat and the side edges 8 are tapered sharply, as shown in FIG. 5, the skin effect acts strongly in a lateral direction (lengthwise in FIG. 5). Therefore, the current is concentrated on the edge 8 having a smaller cross-sectional area, thereby increasing current density, so as to induce an enormous ohmic loss of a high frequency component.

Such an ohmic loss of the high frequency component caused by the high current density is not preferable in view of the properties of the dielectric device for high frequency application. An influence of such a loss becomes more serious particularly in the case of a multi-layer dielectric device.

SUMMARY OF THE INVENTION

The present invention has been accomplished in an attempt to solve the above-described problem. An object of the present invention is to provide a dielectric device having a reduced ohmic loss, more particularly, a dielectric device for high frequency application in which a loss of a high frequency component can be reduced and, still more particularly, such a multi-layer dielectric device.

Furthermore, another object of the present invention is to provide a method for forming the above-described dielectric device.

In order to achieve the above-described objects, according to the present invention, a dielectric device comprising at least a dielectric on which a conductor is disposed and another dielectric laminated on the dielectric is characterized in that a dielectric with a dielectric constant lower than those of said dielectrics is disposed in the vicinity of the side edge of the conductor.

As described above, the dielectric having a different dielectric constant is formed in the vicinity of the conductor, in particular, in the vicinity of the tip of the conductor, so that a current flowing in the conductor can be attracted to the dielectric having a higher dielectric constant. That is, it is possible to alleviate the concentration of the current on the side edge of the conductor so as to reduce an ohmic loss of a current component caused by the current concentration.

A preferred embodiment according to the present invention is characterized in that a cavity is formed in such a manner as to face the side edge of the conductor.

With the above-described constitution, substantially only air exists in the cavity. Since the dielectric constant of the air is remarkably lower than that of the dielectric, there is a markedly advantage in alleviating the concentration of a current on the side edge of the conductor facing to the cavity.

Furthermore, according to the present invention, a method for forming a dielectric device comprises at least steps of disposing a conductor on a dielectric; and of laminating another dielectric on the dielectric, is characterized by comprising steps of: applying a sintering treatment wherein a heating temperature is controlled in such a manner as to deform the conductor and form a cavity facing to the side edge of the conductor after the another dielectric is laminated on the dielectric whereon the conductor is disposed; and cooling the dielectric device while keeping the cavity.

As described already, the dielectric device is generally pressed in its thickness direction during the process for forming the dielectric device. The conductor is pressed between the dielectrics by such pressing, thereby exhibiting the flat shape having the sharply tapered side edges. However, by the method according to the present invention, the heating temperature during the sintering treatment is precisely controlled to become a temperature for allowing the conductor to be deformed, in particular, to become a temperature higher than a melting point of the conductor for allowing the conductor to be molten and the side edge to be deformed into a rounded shape due to surface tension. As a result, the cavity is formed in such a manner as to face the side edge. Thereafter, the cooling treatment is performed in order to keep such a state, thus forming the dielectric device. In the dielectric device thus formed, it is possible to alleviate the concentration of the current on the side edge of the conductor caused by the difference in dielectric constant between the dielectrics, and further, to avoid any local concentration of the current density on the surface of the conductor owing to the rounded shape of the edge. Namely, the dielectric device according to the present invention is remarkably effective to reduce the ohmic loss.

The present invention is aimed at a dielectric device for any high frequency application.

DETAILED DESCRIPTION OF THE INVENTION

Figure 1:
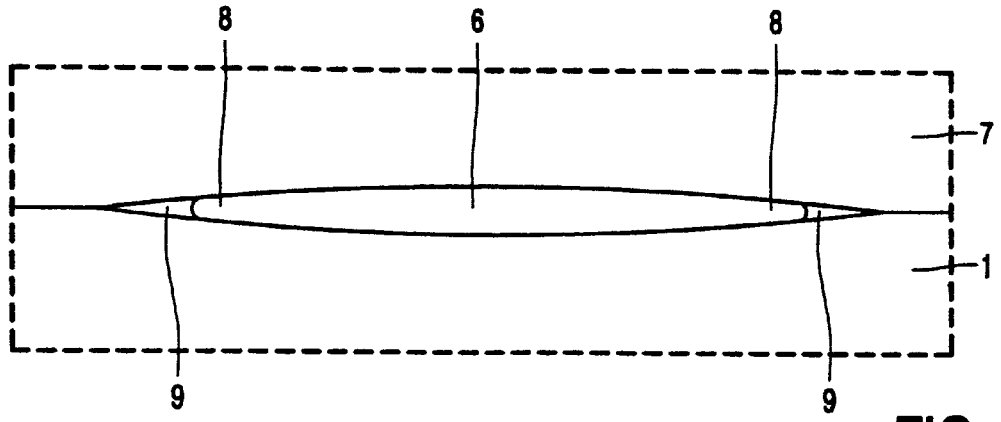
FIG. 1 is a schematic cross-sectional view showing a part of a dielectric device for high frequency application, cut away in a thickness direction, in a first preferred embodiment according to the present invention.

The invention will now be described in greater detail with reference to the figures of the drawing.

Figure 5:
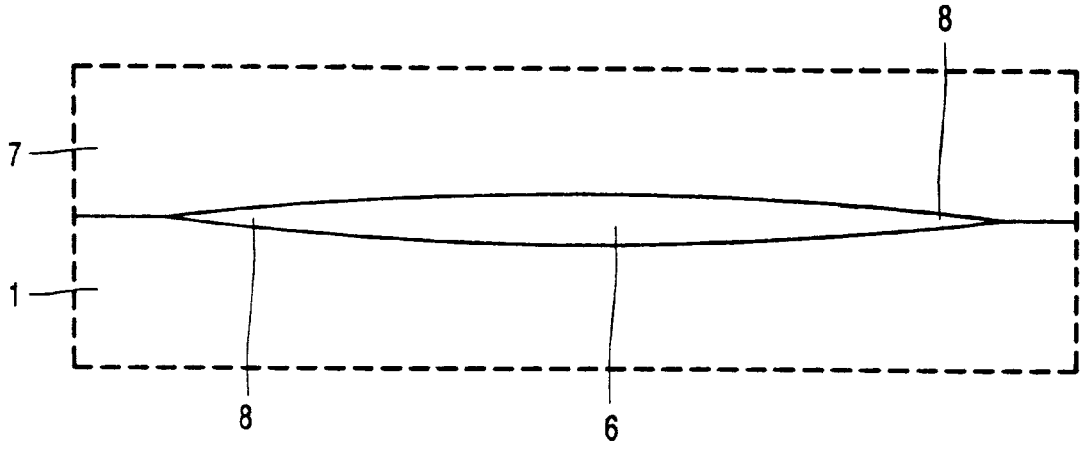
FIG. 5 is a schematic cross-sectional view showing a part of the conventional dielectric device for high frequency application, cut away in a thickness direction.

FIG. 1 is a schematic cross-sectional view showing a dielectric device for high frequency application, partly cut away in a thickness direction, in a first preferred embodiment according to the present invention. In FIG. 1, the same reference numerals designate like or corresponding component parts of FIG. 5. A difference from the conventional device resides in that a cavity 9 is formed in such a manner as to face a side edge 8.

Figure 3:
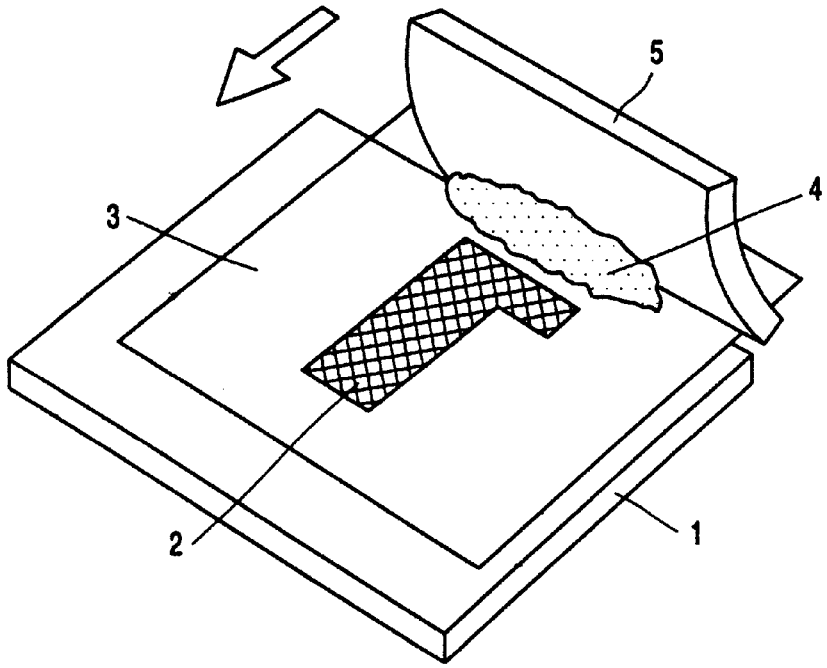
FIG. 3 schematically illustrates a step of disposing an inner electrode according to a conventional dielectric device for high frequency application.

The high frequency dielectric device in the present embodiment is formed, as described below, in a manner similar to the prior art except for the sintering treatment. First, there is prepared a green sheet made of a dielectric material, e.g., a ceramic material. Electrode paste including mainly silver and an organic binder in an appropriate quantity is applied to a desired position on the sheet by, e.g., silk printing, followed by drying, thereby obtaining an inner electrode. A detailed description will be given below. As shown in FIG. 3, a screen stencil mask 3 with an opening having a desired shape, i.e., a screen mesh 2 in this example formed thereon is aligned at a desired position on a ceramic green sheet 1. Next, electrode paste 4 is applied onto the mask 3 and spread in a direction, e.g., indicated by an arrow in FIG. 3 by the use of a rubber squeezer 5. As a result, the electrode paste 3 is applied onto the green sheet 1 through the screen mesh 2, followed by drying, thus forming an inner electrode.

Figure 4:
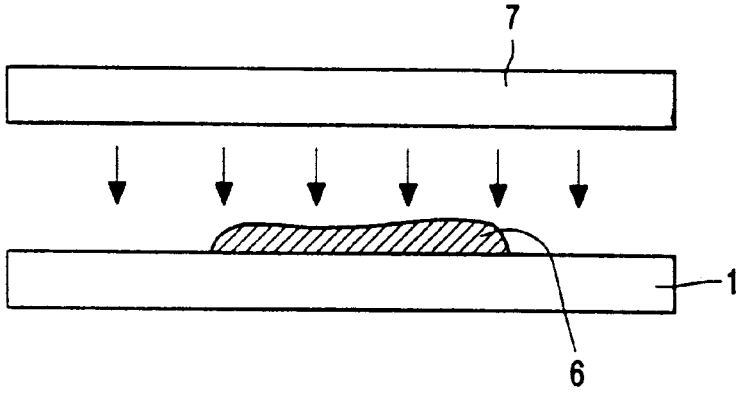
FIG. 4 schematically illustrates steps of laminating and pressing after disposing the inner electrode according to the conventional dielectric device for high frequency application.

Subsequently, as shown in FIG. 4, another ceramic green sheet 7 is laminated on the green sheet 1 having the inner electrode 6 printed at the upper surface thereof, followed by pressing so as to bring both the sheets into close contact with each other. Thereafter, a sintering treatment is performed by heating. The green sheet 7 may be provided with an electrode at the upper surface thereof in a manner similar to the sheet 1, or may be a dummy green sheet having no electrode thereon. A multi-layer dielectric device is obtained by combining the desired number of pairs of a green sheet having an electrode formed at the upper surface thereof and a dummy green sheet having no electrode thereon. And then, a given outer electrode is disposed at a predetermined side surface, thus forming a dielectric device.

In the present embodiment, a heating temperature during the sintering treatment is controlled to become higher than a melting point of the inner electrode 6. Consequently, the inner electrode 6 is molten, thereby forming the cavity 9 facing to the side edge 8 of the electrode while deforming the edge of the molten electrode into a rounded shape owing to surface tension. A cooling treatment is performed so as to keep such a state, thus forming the dielectric device shown in FIG. 1.

Since the cavity 9 has a dielectric constant remarkably lower than that of the dielectric, i.e., ceramic in the present embodiment, a high frequency current flowing in the inner electrode 6 cannot be concentrated near the surface of the electrode, but flows in a wide region near the center of the electrode. That is, it is possible to remarkably reduce a loss of a high frequency component caused by an ohmic loss. As described above, since the edge 8 of the inner electrode 6 is formed into a rounded shape, there is an advantage in avoiding any local concentration of current density on the surface of the electrode.

Although the material including mainly silver and the organic binder in an appropriate quantity is used as the material of the inner electrode, it is further effective to add metal capable of increasing surface tension at the time of the melting in the sintering treatment.

Figure 2:
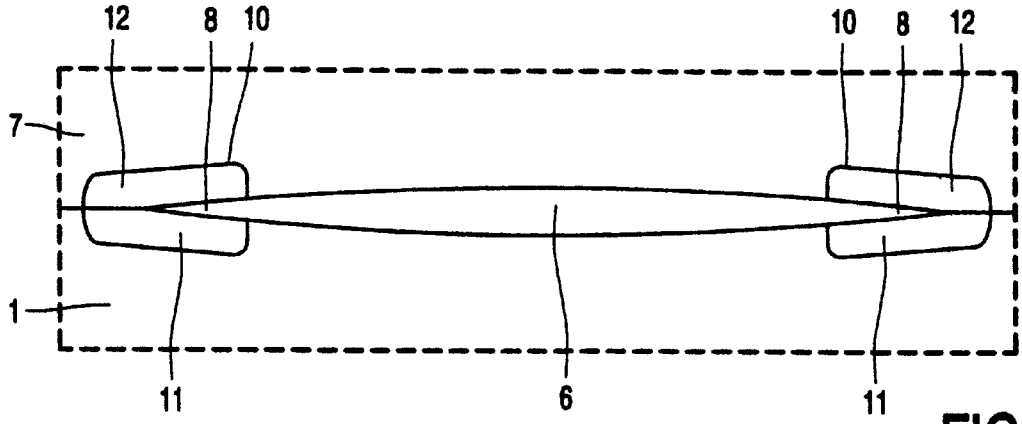
FIG. 2 is a schematic cross-sectional view showing a part of a dielectric device for high frequency application, cut away in a thickness direction, in a second preferred embodiment according to the present invention.

FIG. 2 shows a second preferred embodiment according to the present invention. In FIG. 2, the same reference numerals designate like or corresponding component parts of FIG. 1. A difference of the second embodiment from the first embodiment according to the present invention resides in that a dielectric 10 having a dielectric constant lower than those of dielectrics 1 and 7, i.e., that of ceramic in the present embodiment, is disposed in the vicinity of a side edge 8 of an inner conductor 6. Examples of materials for the dielectric 10 include glass, mica, ceramics including glass or mica, and the like.

In forming the dielectric shown in FIG. 2, for example, a lower portion 11 of the dielectric 10 having a dielectric constant lower than that of the dielectric 1 is first disposed at a predetermined position on the dielectric 1. Subsequently, the inner electrode 6 is disposed at the upper surface of the dielectric 1 in such a manner that the side edge 8 is positioned on the dielectric 10. Thereafter, an upper portion 12 of the dielectric 10 is disposed above the side edge 8, followed by laminating the another dielectric 7. In the second embodiment, it is unnecessary to set a heating temperature during a sintering treatment above a melting point of the inner electrode 6.

As is obvious from the above description, the dielectric device according to the present invention is advantageously applicable to the dielectric device for any high frequency application in which a loss of a high frequency component is not preferable.

What is claimed is:

1. A dielectric device comprising a first dielectric, a conductor disposed on a first surface of said first dielectric, a second dielectric laminated to the first surface of said first dielectric, characterized in that a third dielectric with a dielectric constant lower than those of said first and second dielectrics is provided adjacent to a side edge of the conductor and in that said side edge of the conductor is tapered.

2. A dielectric device as claimed in claim 1, characterized in that the dielectric device is intended for high frequency application.

3. A dielectric device comprising a first dielectric, a conductor disposed on a first surface of said first dielectric, a second dielectric laminated to the first surface of said first dielectric, characterized in that a tapered cavity is provided adjacent to a side edge of said conductor and said side edge is tapered.

4. A dielectric device as claimed in claim 3 characterized in that the dielectric device is intended for high frequency application.

* * * * *